United States Patent [19]

Lafon

[11] Patent Number: 4,542,773

[45] Date of Patent: Sep. 24, 1985

[54] PORTABLE MACHINE DESIGNED FOR THE AUTOMATIC INSTALLATION OF WIRE TIES ON CONCRETE REINFORCING STEEL FRAMES AND OPERATION THEREOF

[76] Inventor: Guy Lafon, 22 Avenue De Beauregard - Cran Gevrier, Haute Savoie, France

[21] Appl. No.: 619,855

[22] Filed: Jun. 12, 1984

Related U.S. Application Data

[63] Continuation of Ser. No. 309,140, Oct. 6, 1981, abandoned.

[30] Foreign Application Priority Data

Oct. 7, 1980 [FR] France ..... 80 21785

[51] Int. Cl.[4] ..... B21F 9/02

[52] U.S. Cl. ..... 140/93.6

[58] Field of Search ..... 140/93.6, 93 A, 57, 140/118, 119, 122; 100/31, 33 R

[56] References Cited

U.S. PATENT DOCUMENTS

| | | | |
|---|---|---|---|
| 876,573 | 1/1908 | Myers | 140/93 A |
| 2,403,396 | 7/1946 | Raney | 100/33 R |
| 3,391,715 | 7/1968 | Thompson | 140/93.6 |
| 4,252,157 | 2/1981 | Ohnishi | 140/93.6 |

*Primary Examiner*—Lowell A. Larson
*Assistant Examiner*—Linda McLaughlin
*Attorney, Agent, or Firm*—Remy J. VanOphem

[57] ABSTRACT

A method of tying a wire tie about two crossed reinforcing steel sections and a portable machine, used for automatically installing wire ties on the steel reinforcing bars used in concrete building structures. The machine includes a fixed upper stop piece, two lower jaws, a wire feeding device, a wire guide which includes a spiraling channel divided into several complementary sections cut from a number of independent pieces, a hinged pair of tongs, a rotating pair of tongs and a cutting edge. The wire tie holding together two reinforcing steel sections has the general shape of a "figure 8" loop which is bent perpendicularly to its plane, both loops of the "figure 8" face each other, the locking twist being located at the center crossing of the "figure 8". This machine may be readily adapted to various dimensions of steel cross-sections.

11 Claims, 12 Drawing Figures

PORTABLE MACHINE DESIGNED FOR THE AUTOMATIC INSTALLATION OF WIRE TIES ON CONCRETE REINFORCING STEEL FRAMES AND OPERATION THEREOF

BACKGROUND OF THE INVENTION

This is a continuation of application Ser. No. 309,140, filed Oct. 6, 1981, abandoned.

The present invention pertains to a portable machine designed for the automatic installation of wire ties on the reinforcing steel used in concrete building structures.

The wire ties holding together the spurs and the main members of the concrete reinforcing frames are usually installed manually by a worker using a pair of pliers or a semi-automatic tool designed to help in making the final locking twist of the tie. In this case, the twist represents the only automatic operation which may be performed either by means of a mechanical device or by means of a power tool. The manufacture of wire ties, however, involves a large amount of time consuming manual operations requiring a trained personnel.

The invention eliminates these disadvantages by offering a machine which provides an entirely automatic process for the manufacture of wire ties. The only operation required from the operator consists of a single pressure on the cycle start button. The machine then automatically opens at the end of the cycle, thus indicating to the operator that it is now ready for the next wire tie.

The machine of the present invention may also be suspended on a jib and balanced so as to be effortlessly operated, the various cycle operations being hydraulically controlled from a hydraulic power station connected with the machine by flexible hoses.

The machine of the present invention may also be automatically adapted to various dimensions of reinforcing steel sections, so as to provide uniformly tight wire ties.

With the machine of the present invention, wire ties can be made between crossed reinforcing sections, as well as on straight or bent sections and on elbows.

Finally, the purpose of the present invention is to make safety wire ties that have the general shape of a figure "8" which is bent perpendicularly to its plane so that both loops face each other, the locking twist being located at the center crossing of the figure 8.

SUMMARY OF THE PRESENT INVENTION

A portable machine designed for the automatic installation of wire ties on reinforcing steel sections at their crossing point, according to the invention, includes the following components.

A fixed upper stop piece comes over the crossing point of the reinforcing sections, whereas two lower jaws are hinged on a common horizontal pin of the machine so that their free ends press the reinforcing steel sections against the fixed upper stop piece. This machine also includes a wire feeding device, a wire guide made of several independent pieces which may be arranged around the crossing of the reinforcing steel actions as a spiraling channel guide, a hinged pair of tongs, a rotating tong assembly used to twist the wire, as well as a cutting edge.

According to the preferred embodiment of the present invention, the wire feeding device includes two rollers used to clamp the wire fed to them, a double acting cylinder which brings the rollers closer together or further apart, and a second double acting cylinder to control the rotation of the rollers through a rack and pinion transmission system. Finally, the wire feeding device also includes a forming piece consisting of a channel guide whose straight upper portion is pointed toward the two rollers, and whose bent lower portion represents the start of the spiraling guide.

Furthermore, in the preferred embodiment of the present invention, the spiraling channel guide is orientated in such a way as to define a coil whose axis is slightly tilted relative to the main frame member, and whose ends are roughly parallel with the spur of the frame at the crossing point thereof.

According to another feature of the present invention, the wire guide includes several spiraling channel sections. These sections are grooved into the upper stop piece, into the first lower jaw located near the wire feeding device, and into the second lower jaw located near the hinged and rotating tongs.

According to still another feature of the present invention, each lower jaw includes two parts which are made semi-indpendent one from another by a joint pin, located parallel with the hinge pin on which the lower jaws are mounted, and by a return spring compressed between these two parts. As the frame sections are clamped by the machine, the following occurs:

The first part of the lower jaw, that is, the part which is directly hinged along the horizontal pin of the machine, and whose groove represents one channel section, is pressed against a fixed part of the machine and in a position which is totally unrelated to the size of the frame sections.

The second part of the lower jaw presses the reinforcing frame sections against the fixed upper stop pieces, as a result of the return spring's action. This part automatically positions itself in rotation around the joint pin, as required by the size of the reinforcing frame sections.

According to yet another feature of the present invention, the second lower jaw, that is, the lower jaw which is close to the hinged tongs and to the rotating tongs, is mounted in such a fashion as to slide when activated by a cylinder, thus coming closer to or further away from the first lower jaw.

According to still another feature of the present invention, the hinged tongs include a body, one end of which is interconnected with the free end of a drive link and a return spring which biases the tongs body upwardly. A cam surface is located along the upper edge of the tongs body and designed to interface with a roller mounted on a fixed pin. A clamping lever having an end mounted to a pivot of the tongs body, includes a surface that interfaces with the second end of the tongs body so as to constitute the active portion of the hinged tongs. The opposite end of the lever includes a nipple or follower designed to slide along both faces of a contoured blade mounted on the machine.

According to still yet another feature of the present invention, the rotating tong assembly includes, on both sides of the rotation axis, two channels designed to clamp the opposite ends of the wire tie. These channels are limited by a bushing and a central nut in the shape of a truncated cone, so that the wire is clamped at both ends of the tie by an axial displacement of the central nut.

The operation of the machine of the present invention is characterized by the fact that it results in the following actions during the course of each operating cycle:

The stop piece is positioned above the crossing of the reinforcing steel sections to be tied.

Both lower jaws are pivoted upwardly and forwardly, so that the two lower jaw components which include a channel section are locked in a closed position. Meanwhile, the other lower jaw components automatically position themselves and clamp the reinforcing steel sections against the fixed upper stop piece.

The pivot mechanism of the lower jaws activates a first stroke limiter and, consequently, the wire feeding device forces a predetermined length of wire inside of the spiraling channel of the wire guide. During this operation, the wire coils around the reinforcing steel crossing and takes the shape of an elongated coil.

The hinged tongs are moved forward and come into contact with the outer end of the spiraling channel of the wire guide. The second lower jaw is then displaced laterally toward the first lower jaw.

In the meantime, the free end of the wire fed from the spiraling channel penetrates the active portion of the hinged tongs, activating a second stroke limiter. The second stroke limiter causes this pair of tongs to rotate upwardly, the free end of the wire being thus pulled upwardly and being introduced inside one of the two channels of the rotating tongs.

A third stroke limiter then causes the rollers of the feeding device to rotate in the direction that causes the wire to back up. The wire is thus tightened around the reinforcing steel sections with a predetermined tensile stress which only depends on the calibration of a valve provided in the feeding system of the hydraulic cylinder controlling the rollers.

As soon as the predetermined tensile stress is reached, the activation of the valve causes the rollers to spread apart while they keep rotating in the same direction until the cylinder that controls their rotation reaches the end of its stroke.

The completion of the latter operation activates, by means of a fourth stroke limiter, a cutter body which rotates to contact the wire tie and direct the wire tie in the other channel of the rotating tongs. The cutter body continues to rotate to sever the tie wire.

The clamping nut of the rotating tongs slides axially upward to lock the tongs around both ends of the wire tie which are already engaged in the channels.

The rotating tongs start rotating around a fixed axis so as to twist the wire tie. This rotation continues until the wires break under the strain at the upper portion of the twist.

The cylinder used to control the rotation of the rotating tongs is returned backwardly and a breakaway type lug, causes the remainder of the wire that might have stayed in the tongs to fall off.

At the end of the cycle, all mechanisms are automatically reset and ready for the next wire tie operation.

BRIEF DESCRIPTION OF THE DRAWINGS

The attached, schematic drawing will give a better understanding of the invention.

DETAILED DESCRIPTION OF THE PREFERRED EMBODIMENT

Figure 1:
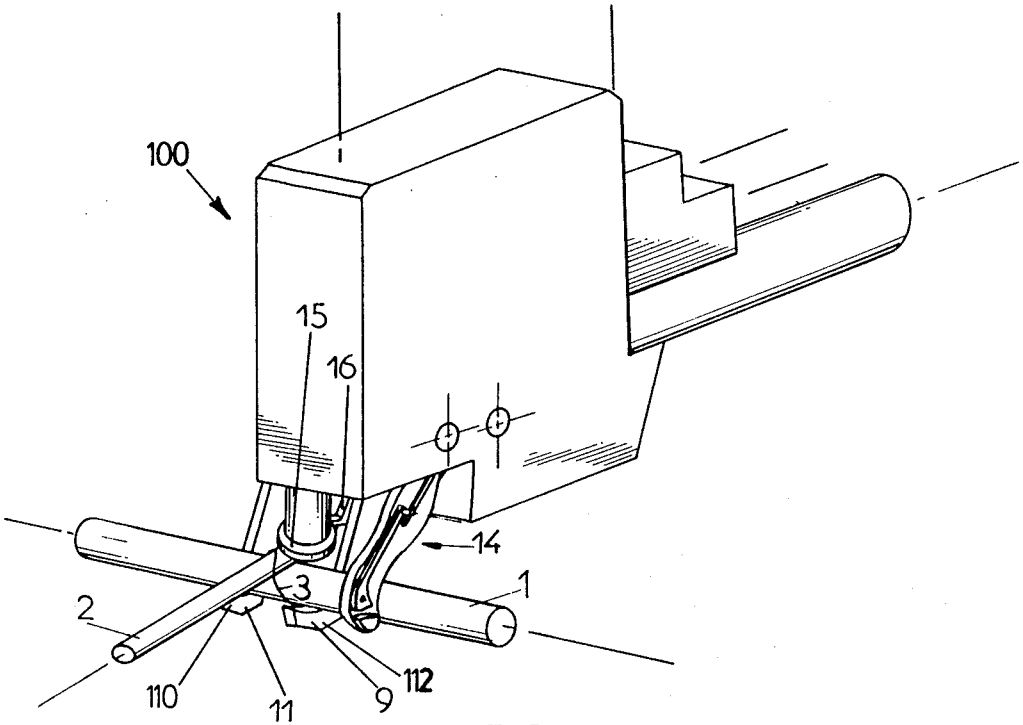
FIG. 1 is a schematic, isometric elevation of a machine as described in the invention.
Figure 2:
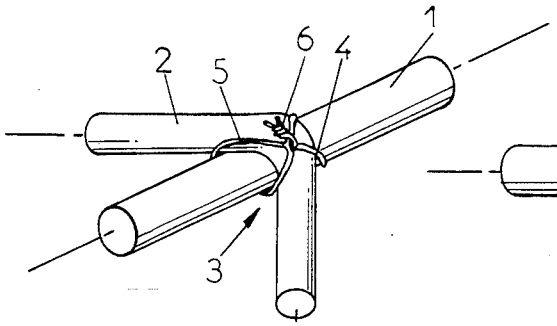
FIGS. 2 and 3 are elevations of two types of wire ties that may be obtained with the invented machine.
Figure 3:
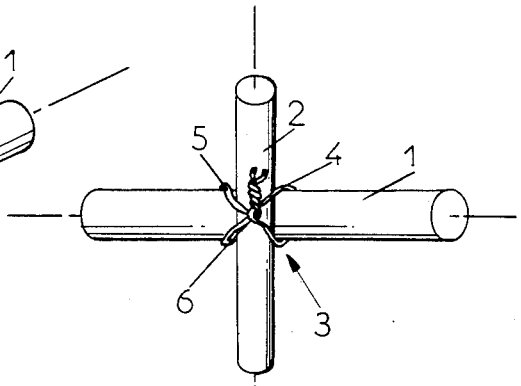

A general view of the invented machine 100 for the automatic installation of wire ties has been represented in FIG. 1. This machine 100 may be used to make the type of wire ties shown in FIGS. 2 and 3, between a reinforcing section or a main member 1 of large section and a reinforcing section or spur 2 of smaller section, at the crossing point of these two reinforcing sections. Furthermore, the wire ties may be made on straight portions of the reinforcing sections (as shown in FIG. 2) and at the elbows of these sections, as shown in FIG. 3. In both cases, the wire tie 3 thus obtained is a safety tie whose general shape is that of a "figure 8" bent perpendicularly to its plane, with two loops 4 and 5 whose ends are facing each other and a locking twist 6 located at the central crossing point of the "figure 8".

The main components of the machine, which will be described in further detail hereinafter, are the following.

Figure 5:
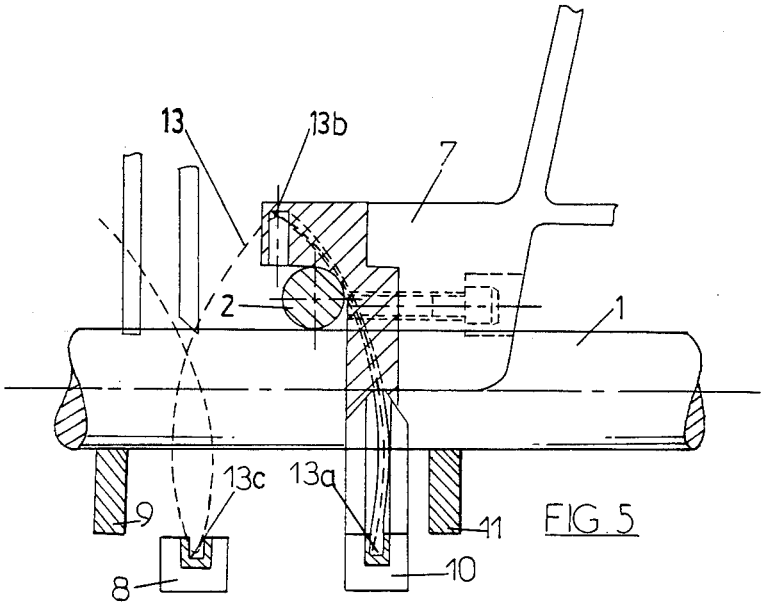
FIG. 5 is a partially schematic partial cross-sectional view along lines V—V of FIG. 4.
Figure 7:
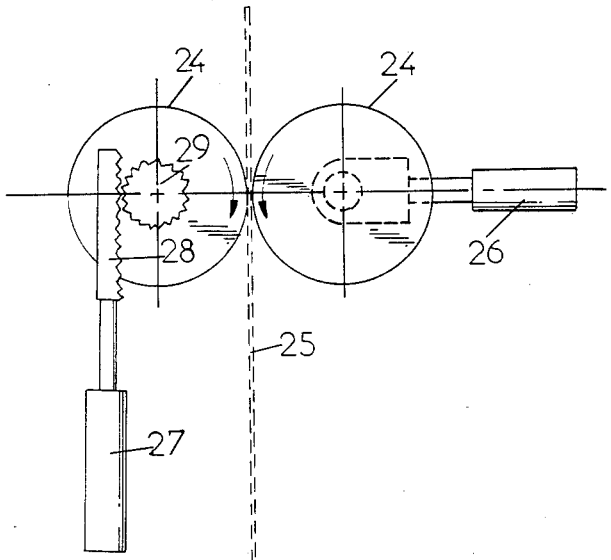
FIG. 7 is a partial cross-sectional view along lines VII—VII of FIG. 6.
Figure 7:
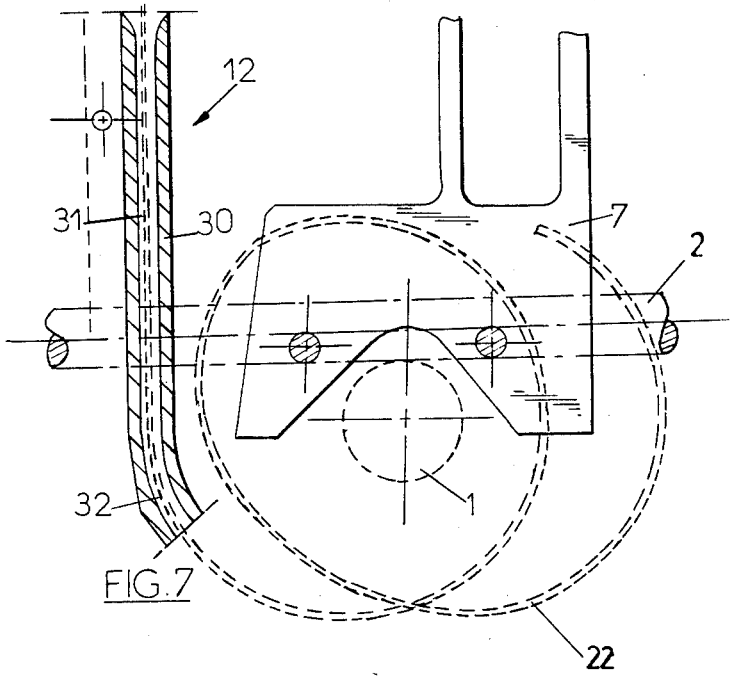

A fixed upper stop piece 7 and two lower jaws 110 and 112, are shown in FIG. 5. A wire feeding device 12 is shown in FIG. 7. A wire guiding device consisting essentially of a spiraling channel 13 including several complementary sections cut from several independent parts are illustrated in FIGS. 5 and 7. A hinged pair of tongs 14, a rotating tong assembly 15 and a cutting edge 16 are illustrated in FIGS. 1 and 8 through 12.

With reference to FIG. 5, the fixed upper stop piece 7 is designed in such a way that it may be brought over the reinforcing sections 1 and 2, at their crossing point. The spur 2 extends above the main member 1, as is more clearly shown in FIGS. 5 and 7. Both lower jaws 110 and 112 are hinged on a common pin 17 and are activated by the hydraulic cylinder 18. Each jaw includes two parts 8 and 9 or 10 and 11 that are made semi-independent from each other and are pivotally interconnected by a pivot pin 19, parallelly aligned with the hinge pin 17. Each lower jaw 110 or 112 is provided with a helicoidal compression spring 20 interposed the parts 8 and 10 and the parts 9 and 11, respectively. The parts 8 and 10 of the lower jaws 110 and 112, both directly hinged on the pin 17, are moved against a fixed abutment, such as fixed rod 102, which is a fixed part of the machine 100, to a position which is totally independent from the size of the reinforcing sections 1 and 2, as the cylinder 18 is retracted. The parts 9 and 11 of the lower jaw 112, pivotally interconnected with the parts 8 and 10 by means of the pivot 19, are moved against the lower face of the reinforcing sections 1 and 2 and press them against the fixed upper stop piece 7 as the cylinder 18 is retracted. This movement is provided by the compression of the springs 20; the latter remaining more or less compressed to allow for the automatic positioning of the jaw parts 9 and 11 according to the size of the reinforcing sections 1 and 2.

Therefore, the compression springs 20 provide a good distribution of the clamping force between both lower jaws 110 and 112, and automatically compensate for the diametrical variations of the rods used in the reinforcing frame.

Moreover, it should be noted that the jaw part 11, located in the general region of the hinged pair of tongs 14 and the tong assembly 15, is mounted to the pin 17 so as to slide axially therealong under the control of a cylinder (not shown), therefore, coming closer or further from the other jaw 110, as indicated by the double arrow 21 in FIG. 5.

Figure 6:
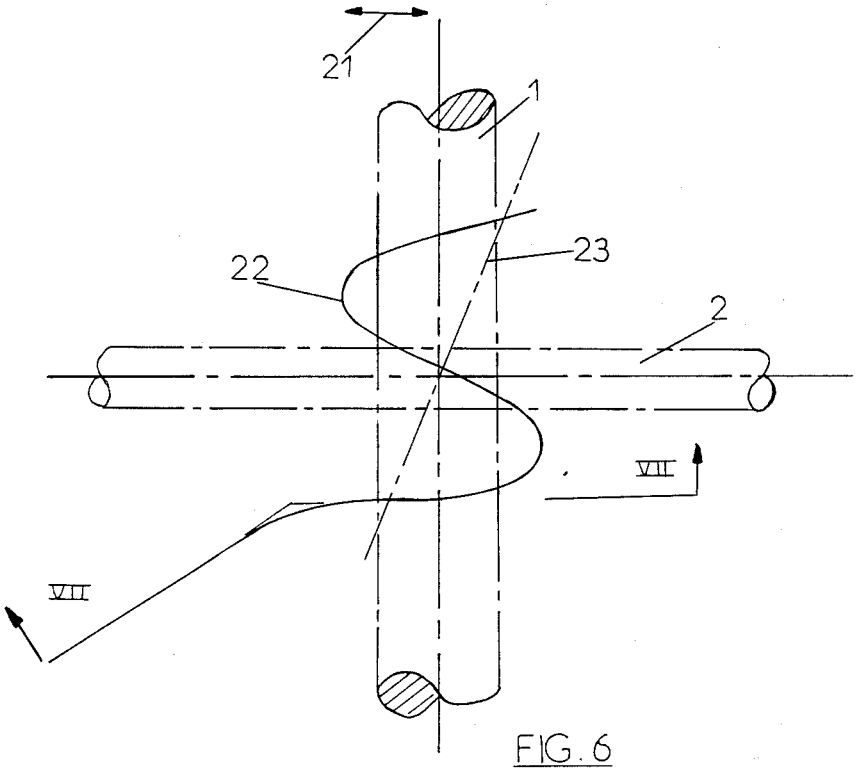
FIG. 6 is a schematic top view showing the course followed by the wire in the spiraling channel of the guiding device.

FIG. 5 shows the various sections 13*a* through 13*c* of the spiraling channel 13 which are grooved both in the upper stop piece 7 and in the parts 8 and 10 of the lower jaws 110 and 112. This channel is orientated in such a way as to define a coil 22, shown schematically in FIG. 6, whose axis 23 is slightly tilted with reference to the main member 1 of the reinforcing frame as shown, and whose ends are roughly parallel with the spur 2 of the reinforcing frame at the crossing point.

The wire feeding device, shown in FIG. 7, includes two rollers 24 designed to clamp, between themselves, a tie wire 25 coming from a wire supply spool which has not been shown. A first double acting cylinder 26 moves the bearing of one of the rollers, so as to bring these rollers closer together or further apart. A second double acting cylinder 27 provides the rotation of one of these rollers by means of a translation mechanism including a rack 28 meshed with a pinion 29. A forming piece 30 for forming the wire into a coil is provided in a predetermined location relative to the channels 13*a* through 13*c*. The forming piece 30 includes a channel guide whose upper portion 31 is straight and pointed toward both rollers, and whose lower portion 32 marks the start of the spiraling channel coil 22 of FIG. 6.

Figure 8:
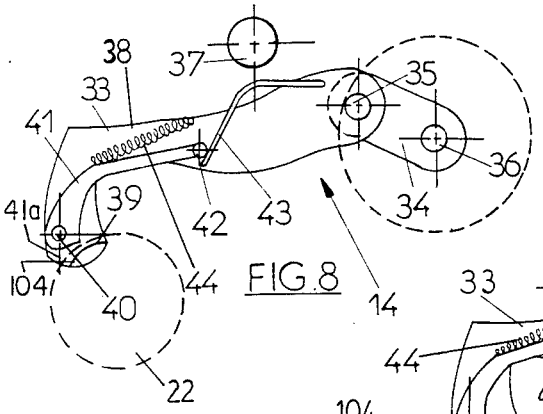
FIGS. 8 through 10 are partial side views of the hinged tongs and illustrating the operation thereof.
Figure 9:
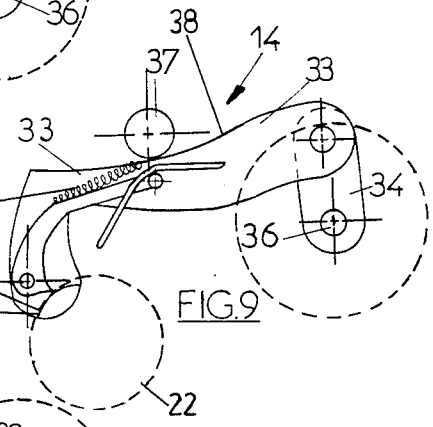
Figure 10:
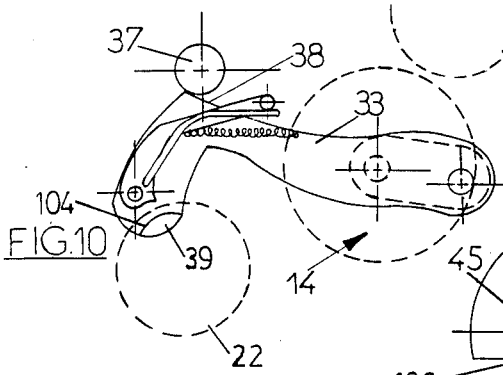

The hinged pair of tongs 14, illustrated in FIGS. 8 through 10, includes a main body 33, one end of which is jointed onto the free end of a drive link 34 by means of a pivot 35. The link 34 pivots around a pin 36, parallel with the pin 17, under the action of a hydraulic cylinder, not shown, and by means of a rack and pinion transmission, also not shown, of the same type as those which activate the rollers 24. A return spring, not shown, compressed between the body 33 and the link 34, constantly biases the body 33 upwardly. This action results in maintaining a cam surface 38, provided on the upper edge of the body 33, pressed against a roller 37. The second end of the body 33 includes an anvil 39. A pivot pin 40 extends from the second end of the body 33 parallel to but spaced away from the anvil 39. A clamping bell crank 41 is mounted to the pivot pin 40. The bell crank 41 carries a follower 42 designed to slide along both faces of a contoured blade 43 mounted on the machine. A spring 44 is provided between the body 33 and the clamping bell crank 41, thus constantly biasing the active edge of the clamping bell crank 41 towards the active face 104 of the crank anvil 39.

Figure 4:
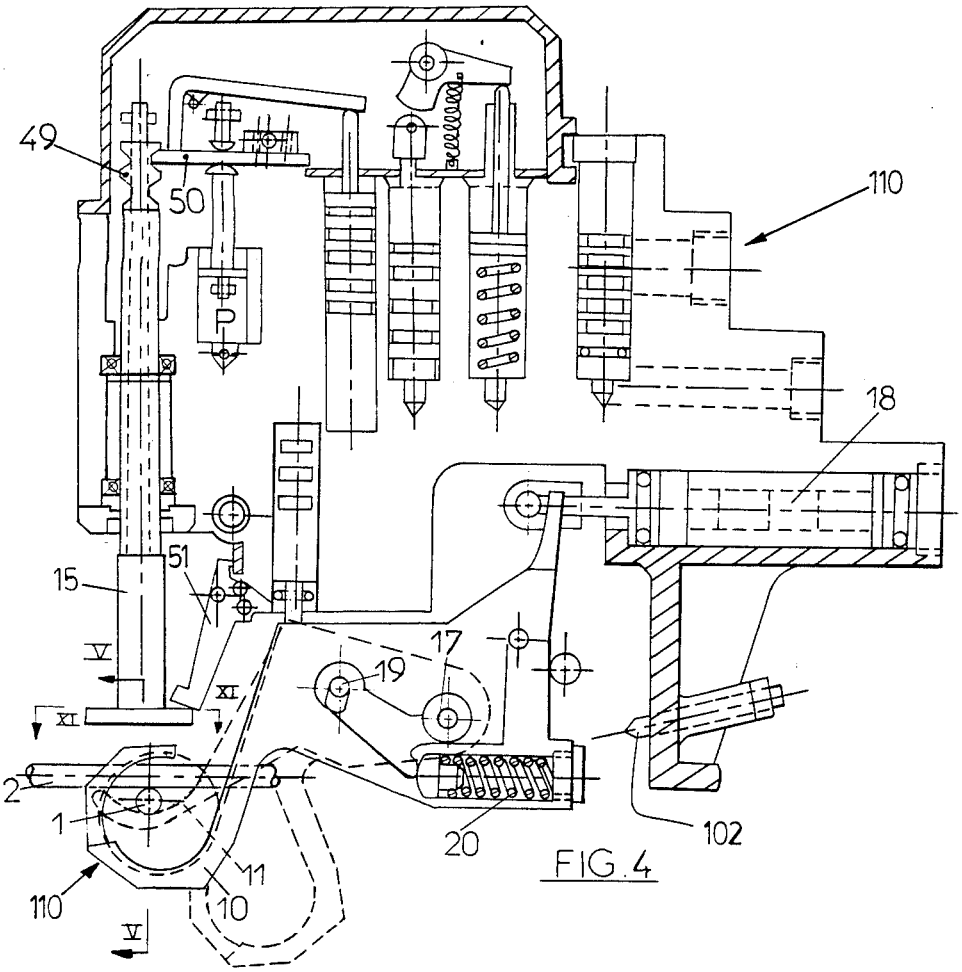
FIG. 4 is a vertical cross-sectional view of the invented machine.
Figure 11:
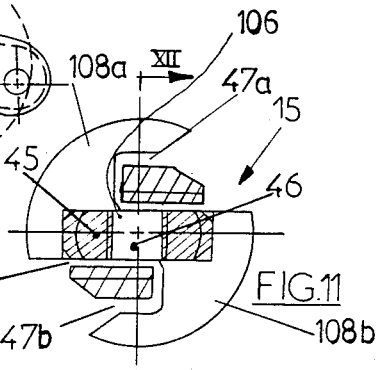
FIG. 11 is a cross-sectional view along lines XI—XI of FIG. 4 showing the rotating tongs.
Figure 12:
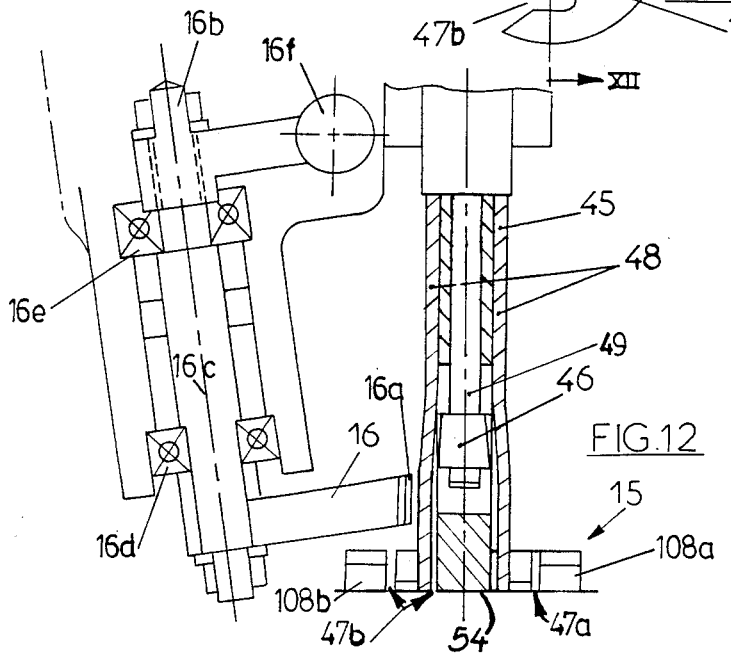
FIG. 12 is a cross-sectional view along lines XII—XII of FIG. 11.

The rotating tong assembly 15, represented in FIGS. 11 and 12, includes two tongs 108*a* and 108*b*, a bushing sleeve 45, a pair of spring blades 48, and a plug rod 49 carrying at one end a conically shaped plug or nut 46 that engages the inside walls of the pair of spring blades 48. The nut 46 is in the shape of a truncated cone, so that the wire is clamped at both ends of the tie by an axial displacement of the nut. Such upward motion of the plug 49 is effected, as may be better seen in FIG. 4, by the upward motion of the plunger P on a follower blade 50 coupled to move the upper end of the plug rod 49. This rotating pair of tongs includes two channels 47*a* and 47*b* which are symmetrically located on opposite sides of the longitudinal axis of the supporting structure 106. The channels 47*a* and 47*b* are narrowed by an axial upward motion of the nut 46. The nut 46 contacts the pair of spring blades 48, thereby displacing the pair of spring blades 48 outward, so that the channels 47*a* and 47*b* are narrowed by the outward movement of the pair of spring blades 48. The channels are designed to clamp the opposite ends of the wire tie, as will be apparent shortly from the following description of the operation of the present invention.

The cutting assembly 16, located adjacent to the tong assembly 15, is illustrated in FIG. 12. The cutter assembly 16 includes a cutting edge 16*a* which is attached to a cutter body 16*c*. The cutter body 16*c* rotates on bearings 16*d* and 16*e* about the cutter rotation axis 16*b*. The cutter body is rotated by a suitably actuated lever 16*f*.

The operation of the present invention is as follows during each cycle of the machine:

The fixed upper stop piece 7 having the section 13*b* is brought over the crossing point of the reinforcing sections 1 and 2 which are to be tied. The lower jaws 110 and 112 are in the lowered position indicated by the dashed lines of FIG. 4.

Both lower jaws 110 and 112 are pivoted upwardly and forwardly so that the two jaw parts 8 and 10, which include sections 13*a* and 13*c* of the channel 13, are locked in shut position. Meanwhile, the jaw components 9 and 11 automatically position themselves and clamp the reinforcing steel sections 1 and 2 against the fixed upper stop piece 7, thereby completing the channel 13.

The pivot mechanism of the lower jaws having activated a stroke limiter, which then causes both rollers 24 to rotate so as to force a preset length of wire into the spiraling channel 13 of the guiding device. The wire lead into the channel 13 is stressed to effect the forming of a coil 22 of elongated pitch. The wire then coils around the reinforcing steel sections 1 and 2 in the same manner as observed in the case of a crossed wire tie manually made by construction workers and as shown in the "figure 8" in FIGS. 2 and 3 of the drawing. The coil, tilted in the above described manner, includes two extreme portions which are roughly parallel with the reinforcing spur 2. This arrangement enables the operator to bring the wire closer to the reinforcing sections, so as to obtain a maximum tightness of the wire tie. Indeed, the initial portion of the coil is coiled as close as possible to the spur 2. The final axial positioning of the component 11 of the jaw 112 toward the jaw 110 results in lowering the end portion of the coil against the spur 2.

As the wire stops advancing inside the channel 13, and before the jaw part 11 is advanced towards the lower jaw 112 in the above described manner. The hinged tongs are advanced from the neutral position shown in FIG. 10, forward to a fully extended position by rotation of the drive link 34, so that the anvil 39 and the bell crank 41 are in contact with the end of the jaw part 8. During the extension of the pair of hinged tongs 14, the follower 42 of the bell crank follows the surface of the contoured blade 43, thereby forcing the bell crank 41 to move to form an opening between the locking surface 41*a* of the bell crank 41 and the active face 104 of the anvil 39.

The rollers have begun to rotate and feed the tie wire 25 through the forming piece 30 into the channel 13. As the wire travels sequentially through the channels 13*a*, 13*b*, and 13*c* it forms a spiral. The wire is fed through the channel until the wire penetrates the opening between the locking surface 41*a* and the active face 104 of the bell crank 41, as shown in FIG. 8.

The length of wire to be delivered to the rollers is predetermined when the rollers 24 stop rotating, the end of the wire 25 penetrates the opening of the pair of tongs 14. When the wire 25 penetrates inside the hinged tongs 14 between the bell crank 41 and the anvil 39 and activates a first stroke limiter, which causes the hinged tongs to pivot upwardly (FIGS. 8 through 10). In the course of this motion, the wire is pulled upwardly and backwards, and is introduced in the channel 47*a* of the rotating tong assembly 15. The cam surface 38 accurately defines the motion of the body 33 of the hinged tongs, and while the wire is pulled, both upwardly and backwards, the clamping power supplied by the spring 44 is augmented as the follower 42 comes in contact with the front face of the contoured blade 43 as illustrated in FIG. 8.

A second stroke limiter, activated by the component 11 of the jaw 112, induces the rotation of the rollers 24 in the direction which causes the wire to back up and to be thus tightened around the reinforcing pieces. The tightness thus obtained does not depend on the dimensions of the reinforcing sections, but solely depends on the drawing power of the rollers. This tightness is constant and its value is preselected. A calibrated valve placed on the hydraulic system of the cylinder 27 monitors the resisting stress applied by the wire to the rollers 24. As the stress increases, that is, as the wire reaches the maximum preselected tension, the calibrated valve is activated and causes the relative spreading of the rollers by means of the double acting cylinder 26, while permitting the rollers to reach the end of their backwards rotation cycle and reset point.

The disengagement of the wire from the rollers prevents any damage to the wire due to a possible slippage of the rollers, and the wire to be used for the next wire tie remains therefore undamaged.

As the rollers reach the end of their backwards rotation cycle, the cutting assembly 16 is activated. The cutting edge 16*a* of the cutter assembly rotates about the cutter rotation axis 16*b* as the cutter body 16*c* rotates on bearings 16*d* and 16*e*. The cutter body 16*c* is rotated by a suitably actuated lever 16*f*. As the cutter body 16*c* rotates the cutting edge engages the wire exiting the forming piece 30, and as the cutter body 16*c* rotates further, the wire is directed into the channel 47*b* of the rotating tong assembly 15. As the cutter body 16*c* rotates further, the cutting edge 16*a* cuts the wire.

The nut 46 moves axially upwardly inside the bushing sleeve 45 of the rotating tong assembly 15 to draw the nut 46 into contact with the pair of spring blades 48, directing the pair of spring blades outward and thereby narrowing the channels 47*a* and 47*b* so as to lock the wire 25 in the channels 47 of the rotating tongs. The cutter edge 16*a* recoils to the start position and the rotating tong assembly 15 then begins to rotate in order to make the twist 6 of FIGS. 2 and 3. One of the innovations brought by this process is that the number of rotations of the rotating tong assembly 15 is increased, thereby inducing the wire to break and sever at a point that is flush with the tongs. The assembly has been designed so that the severance occurs in the upper portion of the twist, without damaging the portion of the wire in the lower portion of the twist.

The hydraulic cylinder which controlled the rotation of the rotating tongs then follows a return stroke during which the tongs rotate in the opposite direction and the nut 46 slides downwardly. At that time, a breakaway lug 51 moves towards the rotating tong assembly 15 (FIG. 4) in order to push away the upper portion of the wires which could otherwise still remain in the tongs.

At the end of the operation, all mechanisms are automatically reset and ready for the next wire tie. In particular, the link 34 of the hinged tongs 14 continues to rotate slowly until it reaches the end of its stroke, thereupon causing the follower 42 to move away from the contoured blade 43 (FIG. 10). The link 34 then starts rotating in the opposite direction while the follower 42 comes to rest against the rear face of the contoured blade 43, so as to keep the hinged tongs 14 in an open position.

Having thus described the present invention by way of a detailed description of the preferred embodiment, variations therefrom will be apparent to those skilled in the art and are included within the scope of the claims appended hereto.

What is claimed as novel is as follows:

1. A portable machine for the automatic installation of a wire tie around reinforcing steel sections at the point where they cross each other comprising:

a machine housing;

a fixed stop piece attached to said housing adapted to be placed on top of the crossing of the reinforcing steel sections;

two lower jaws, pivotally supported from said housing by a common horizontal pin, the free ends of said jaws operative to press the reinforcing steel sections against said fixed stop piece;

a multi-component wire guiding device defining a spiraling channel guide around the crossing of the reinforcing steel sections;

means disposed adjacent to the other of said two lower jaws for feeding a wire into said wire guiding device, said spiraling channel guide directing said wire into a spiral around the crossing of the reinforcing steel sections;

a hinged pair of tongs disposed adjacent to the other of said two lower jaws adapted to clamp on the free end of the spiraled wire and pull the free end of the wire tight over the crossing of the reinforcing steel sections;

means for reversing said means for feeding to pull the other end of the wire tight over the crossing of the reinforcing steel sections;

means responsive to the other end of the wire being pulled tight for cutting the wire; and a rotating pair of rotating tongs operative to twist the ends of the wire together in response to said wire being cut.

2. The machine as described in claim 1 wherein said means for feeding a wire includes:

two rollers for clamping the wire between themselves;

a first double acting hydraulic cylinder for displacing the rollers closer together or further apart;

a rack and pinion transmission mechanism attached to at least one of said two rollers;

a second double acting hydraulic cylinder for moving said rack to rotate said at least one roller;

a forming part disposed between said rollers and said wire guiding device which includes a channel guide having a straight upper portion adjacent to said two rollers and receiving said wire, and a bent lower portion which consititutes the beginning of the spiraling channel guide of said wire guiding device.

3. The machine as described in claims 1 and 2 wherein said spiraling channel guide of said wire guiding device is oriented to define a coil whose axis is slightly tilted with respect to one member of the reinforcing steel sections, and whose ends are approximately parallel with the other of the reinforcing steel member at the crossing point of said two reinforcing steel members.

4. The machine as described in claim 3 wherein said wire guiding device includes several spiraling channel guide sections that are respectively grooved in said fixed stop piece, in said one lower jaw which is located next to said wire guiding device, and in the other lower jaw which is located on the side of the rotating and hinged tongs.

5. The machine as described in claim 4 wherein each of said lower jaws comprises:

a first element pivotally supported from said housing by said common horizontal pin;

a second element pivotally supported from said first element by a joint pin parallel with said common horizontal pin; and a return spring compressed between said first element and said second element wherein said first element includes said spiraling channel guide and is movable to circumscribe said reinforcing steel section independent of their size and when said second section is urged by said return spring to engage said reinforcing steel sections and hold them firmly against said fixed stop piece wherein said first element circumscribes said reinforcing steel members.

6. The machine as described in claim 5 wherein said other lower jaw, close to said hinged and rotating tongs, is mounted to be displaced closer to or further from the one lower jaw, said machine further includes a hydraulic cylinder for displacing said other lower jaw closer to and further from said one lower jaw.

7. The machine as described in claim 6 wherein said hinged tongs comprises:

a drive link having a free end;

a body having one end pivotally connected onto the free end of said drive link;

a return spring connected between said body and said drive link producing a force which constantly pulls said body upward;

a cam surface provided along the upper edge of said tongs body;

a contoured blade mounted to said housing;

a roller mounted on a fixed pin supported by said housing and interfacing said cam surface; and a clamping lever pivotally connected at one end onto a pivot of said tongs body constituting the active portion of the hinged tongs, the other end of said lever has a nipple designed to slide along both faces of said contoured blade.

8. The machine as described in claim 7 wherein said rotating tongs include:

a tong body adapted to rotate about an axis, said tong body having two channels, one on either side of said axis designed to clamp the opposite ends of said wire;

a hollow bushing attached to said tong body;

a rod slidably and rotatably disposed in said hollow bushing, said rod having an end adaptable for attachment;

a pair of spring blades mounted to said hollow bushing, each of the pair of said spring blades having an end positioned in each of said two channels of said tong body; and a central nut affixed to said end of said rod for displacing said pair of spring blades outward as said rod travels upward, said pair of spring blades clamping the ends of the wire in said two channels as said tong body rotates about said axis.

9. A method for tying a wire tie about two crossed reinforcing steel sections comprising the steps of:

placing the fixed upper stop piece of a wire tying machine above the crossing of the reinforcing steel sections to be tied;

pivoting upward and forward two lower jaws to lock said jaws in a shut position and clamp the reinforcing steel sections against the fixed upper stop piece, said two lower jaws including a wire guide section having a spiraling channel which is automatically positioned around said reinforcing steel sections when said two lower jaws are locked in said shut position;

activating a wire feeding device in response to said two lower jaws being locked in said shut position to force a preset length of wire tie inside the spiraling channel of said wire guide section;

feeding the wire into said spiraling channel to guide the wire around the crossing of the reinforcing steel sections in the shape of an elongated coil;

pulling the free end of the wire, coming out of the spiraling channel, with hinged tongs to tighten the coiled wire tie about the reinforcing steel sections and to introduce the free end of the wire being pulled inside one of the two channels of a rotating tongs;

reversing the feed direction of the wire feeding device in response to said hinged tongs reaching the limit of its pulling motion to pull back the wire further tightening the wire around the reinforcing steel sections;

activating a cutting edge to introduce the wire tie into the other channel of said rotating tongs and to cut the wire tie in response to said feeding device exerting a preset tensile stress on said wire;

activating a clamping nut of the rotating tongs to slide axially and lock both ends of the wire tie which were previously introduced in said channels of said rotating tongs;

rotating the rotating tongs around a fixed axis so as to twist the wire tie until the ends of the wire tie locked in the rotating tongs break off under the strain at the upper portion of the twist;

reversing the direction of rotation of said rotating tongs to activate a breakaway type lug provided on said machine to interpose itself and cause the upper portion of the wire tie which may have remained in said rotating tongs to fall off; and resetting all the mechanisms of said tying machine at the end of the cycle for the next wire tie.

10. The method as described in claim 9, wherein said step of rotating said rotating tongs ties the wire tie in the general shape of a "figure 8" bent perpendicularly to its plane having both loops of said "figure 8" facing each other, and the locking twist being located at the central crossing point of the "figure 8".

11. The method as described in claim 9 wherein said wire feeding devices has a pair of rollers rotated by a first hydraulic cylinder by means of a rack and pinion drive, and wherein said rollers are displaced together and apart by a second hydraulic cylinder and wherein said first hydraulic cylinder includes a valve calibrated to activate said second hydraulic cylinder to displace apart said rollers in response to a preset tensile stress on said wire, said step of reversing the feed direction of said wire feeding device comprising the steps of:

activating said first cylinder in response to said hinged tongs reaching the limit of its pulling motion to rotate said rollers in a direction opposite said feed direction to generate an increasing tensile stess on said wire; and activating said second hydraulic cylinder to displace apart said rollers in response to said valve detecting when the tensile stress on said wire reaches said preset value.

* * * * *

UNITED STATES PATENT AND TRADEMARK OFFICE

CERTIFICATE OF CORRECTION

PATENT NO. : 4,542,773

DATED : September 24, 1985

INVENTOR(S) : Guy Lafon

It is certified that error appears in the above-identified patent and that said Letters Patent is hereby corrected as shown below:

Column 1, line 63, delete "actions" and insert ---- sections ----.

Colunm 2, line 37, delete "pieces," and insert ---- piece, ----.

Column 3, line 64, delete the period "." and insert a semicolon ---- ; ----.

Column 4, line 63, after "pivot" insert ---- pin ----.

Column 6, line 1 after "plug" insert ---- rod ----.

Column 7, line 62, delete "47" and insert ---- 47a and 47b ----.

Column 8, line 1, after "the", first occurrence, insert ---- bottom surface 54 of the rotating ----.

Signed and Sealed this

*Fifteenth* Day of *April 1986*

[SEAL]

*Attest:*

DONALD J. QUIGG

*Attesting Officer*

*Commissioner of Patents and Trademarks*